US005949084A

United States Patent [19]

Schwartz

[11] Patent Number: 5,949,084

[45] Date of Patent: Sep. 7, 1999

[54] RADIOACTIVE MATERIAL STORAGE VESSEL

[76] Inventor: Martin W. Schwartz, 2244 University Ave., Sacramento, Calif. 95825

[21] Appl. No.: 09/107,821

[22] Filed: Jun. 30, 1998

[51] Int. Cl.[6] ..... G21F 5/00

[52] U.S. Cl. ..... 250/506.1

[58] Field of Search ..... 250/518.1, 506.1, 250/507.1

[56] References Cited

U.S. PATENT DOCUMENTS

| | | | |
|---|---|---|---|
| 4,027,377 | 6/1977 | Roszler | 250/507.1 |
| 4,272,683 | 6/1981 | Baatz et al. | 250/507.1 |
| 4,810,890 | 3/1989 | Blum | 250/506.1 |
| 4,825,088 | 4/1989 | Nair et al. | 250/506.1 |
| 5,015,863 | 5/1991 | Takeshima et al. | 250/506.1 |
| 5,786,611 | 7/1998 | Quapp et al. | 250/518.1 |
| 5,819,186 | 10/1998 | Stephens | 250/506.1 |

*Primary Examiner*—Bruce C. Anderson
*Attorney, Agent, or Firm*—John P. O'Banion

[57] ABSTRACT

A storage vessel for radioactive material comprising metallic particles that are, preferably but not necessarily spherical, forming a matrix that includes a moderator and absorber of neutrons. The matrix is disposed between an inner vessel and an outer casing having metallic walls. The walls of the inner vessel contains the radioactive materials and shields against photon radiation, and outer the casing, in addition to photon shielding, also serves as a protective layer against physical impact. The metal particles are ideally composed of depleted uranium, however, lead or other high density metals which can attenuate photon radiation can also be utilized. The matrix includes a neutron attenuating and absorbing mixture which fill the interstices between the metallic particles.

15 Claims, 2 Drawing Sheets

RADIOACTIVE MATERIAL STORAGE VESSEL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to shielding for radioactive materials and more particularly to a lightweight storage container for radioactive materials.

2. Description of the Background Art

At the present time, there are approximately 560,000 tons of depleted uranium hexaflouride under storage in 50,000 cylinders which cost about $10,000,000 annually to maintain. Putting the depleted uranium to practical use would cut the maintenance costs significantly. One such use of depleted uranium is as shielding material for radioactive materials. Using the depleted uranium in such a manner is not only useful, but also serves to eliminate the depleted uranium from the environment.

The storage and/or transportation of radioactive materials require effective shielding to protect the operating personnel and the surrounding environment. The storage and/or transportation of radioactive materials have been accomplished using canisters, containers, receptacles or vessels that possess photon and neutron absorption capability and sufficient structural strength. The radiation absorption capability shields the environment and operating personnel from radiation emitted by the radioactive materials, while structural strength allows the vessel to withstand normal handling and storage stresses and even some accidental impacts upon the vessel.

One such known storage vessel utilizes a hollow body having lateral walls and a base formed unitarily with one another and open at an upper end. The walls of the body have an outer layer, an intermediate layer and an inner layer. The outer and intermediate layers are cast unitarily from a carbon containing ferrous metal of copper alloy while the intermediate layer consists of a cast matrix phase within which heavy metal particles, such as depleted uranium, are embedded to absorb radiation. A plurality of separate channels disposed longitudinally within the outer layer is filled with neutron absorptive material, and a removable cover is fitted over the upper end after the radioactive has been placed therein.

The multi-layer configuration of such storage vessels result in a shielding system that is large dimensionally and in mass, thus limiting the quantity of radioactive material that can be stored, especially when storage area is limited. Without the separate longitudinal channels containing the neutron absorptive material, the vessel would be ineffective, as depleted uranium is useless by itself for neutron absorption. Such a large multi-layer configuration also requires ancillary cooling systems to dissipate heat generated by the enclosed radioactive material.

Accordingly, there is a need for a radiation storage vessel that combines the functions of attenuating photon radiation, neutron absorption and shock mitigation from impact, while minimizing the thickness of the vessel's walls and weight such that the vessel can be more readily transported and a larger quantity of radioactive material can be stored in a given area. The foregoing reflect the state of the art of which the applicant is aware and are tendered with the view toward discharging applicant's acknowledged duty of candor in disclosing information which may be pertinent in the examination of this application. It is respectfully stipulated, however, that none of these teach or render obvious, singly or when considered in combination, applicant's claimed invention.

BRIEF SUMMARY OF THE INVENTION

The present invention is a vessel for the storage and transportation of radioactive materials. The vessel generally comprises a mixture of small metal particles, preferably but not necessarily spherical, embedded in a matrix that contains neutron moderating and absorbing material. The use of spherical particles, however, assures maximum density of packing so that the thickness of the vessel's wall is minimized while allowing sufficient space in the interstices between the particles for the neutron absorber/moderator. The composite mixture of metal particles and neutron absorbing matrix is poured into an annular space between an inner vessel that is used to contain the radioactive material and an outer casing that serves both as a form for the shielding system and a protective covering. The metal particles are composed of depleted uranium, lead or other like material. The inclusion of neutron absorbing material within the matrix eliminates the need for a separate layer of neutron absorptive materials thus reducing the weight and amount of space occupied by the vessel.

An object of the invention is to provide a radioactive material storage vessel which attenuates photon radiation, absorbs neutron emissions and mitigates shock from impacts.

Another object of the invention is to provide a radioactive material storage vessel which minimizes thickness and weight so that a larger quantity of radioactive material can be stored in a minimum amount of space therein, thereby maximizing the efficiency of the storage system.

Another object of the invention is to provide a radioactive material storage vessel which minimizes thickness and weight so that the vessel is more readily transportable.

Another object of the invention is to provide a radioactive material storage vessel in which heat generated by the radioactive contents can be more easily dissipated by thermal conduction.

Still another object of the invention is to provide a radioactive material storage vessel which allows retrieval of the metal components of the storage vessel using conventional techniques.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
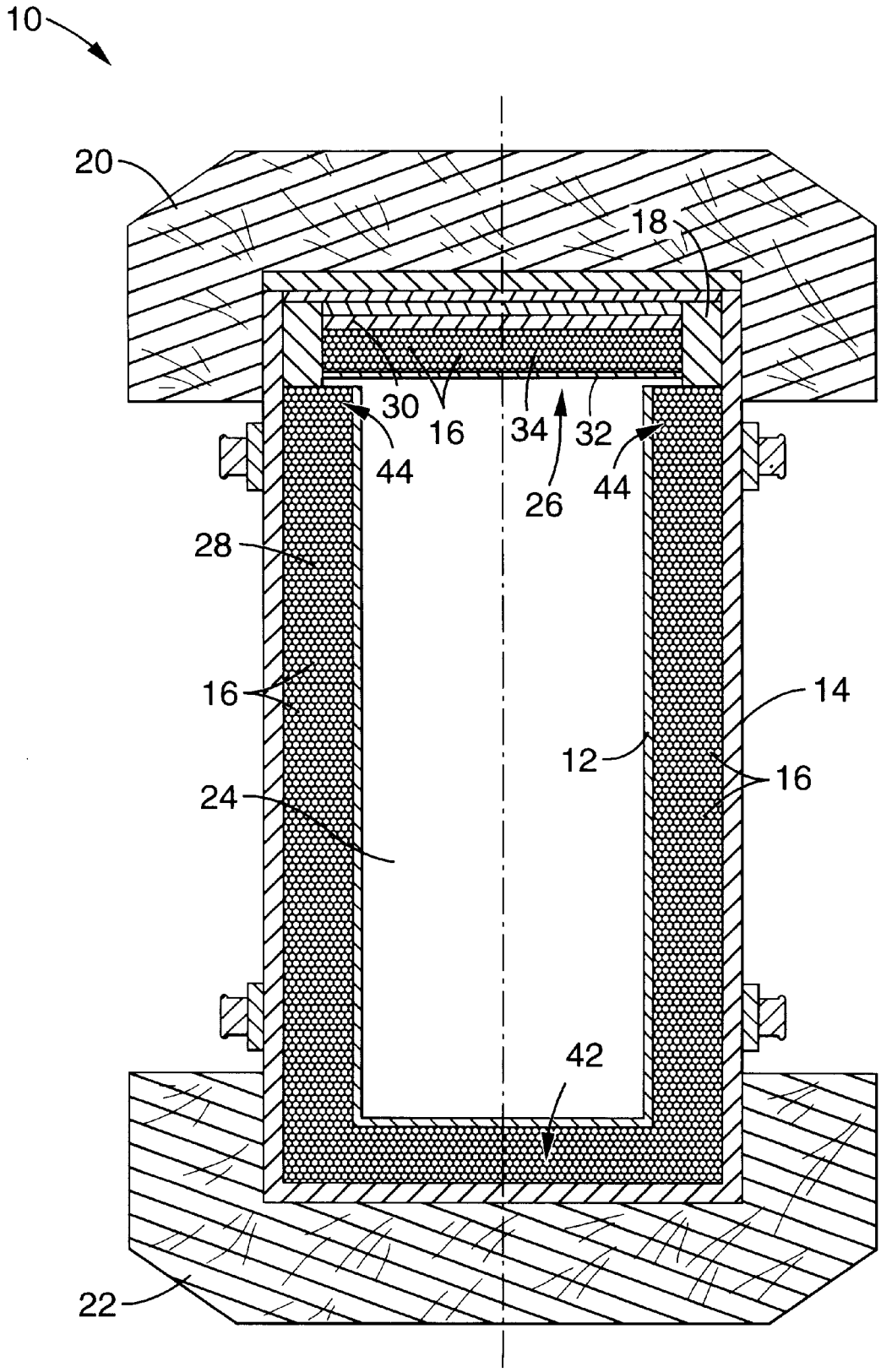
FIG. 1 is a vertical cross-sectional view of a storage vessel apparatus in accordance with the present invention.
Figure 2:
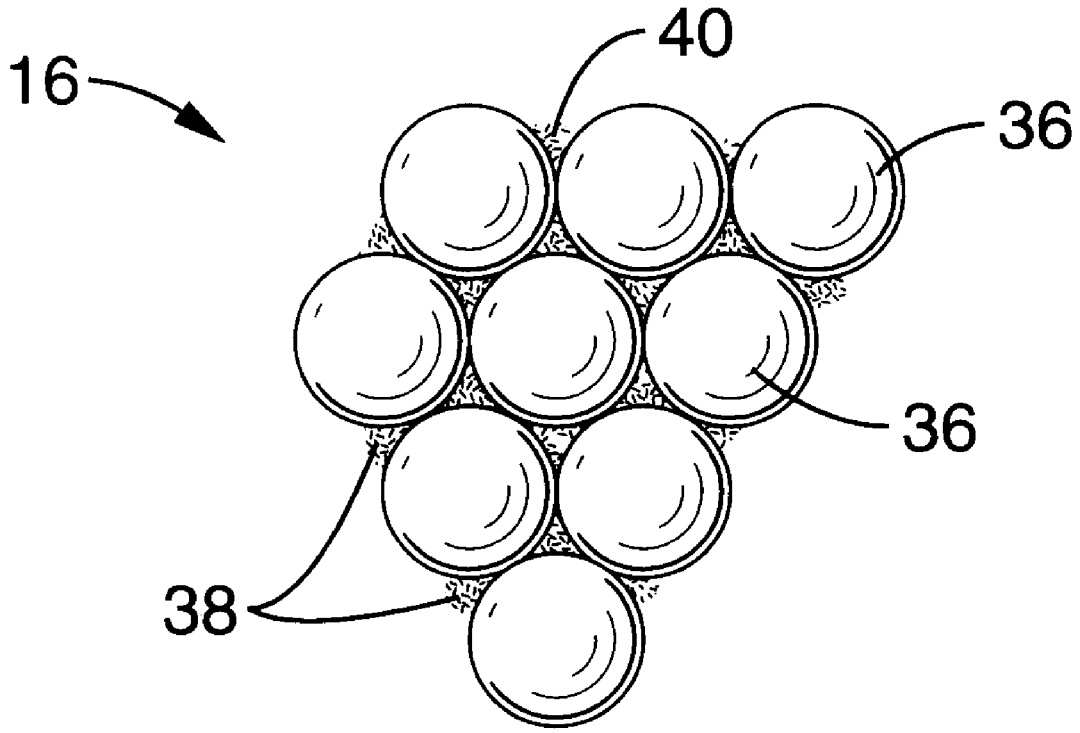
FIG. 2 is a detail view of the neutron shielding matrix as shown in FIG. 1.

Referring more specifically to the drawings, for illustrative purposes the present invention is embodied in the apparatus generally shown in FIG. 1 through FIG. 2. It will be appreciated that the apparatus may vary as to configuration and as to details of the parts without departing from the basic concepts as disclosed herein.

Referring to FIG. 1, a radioactive material storage apparatus 10 in accordance with the present invention is generally shown. Apparatus 10 generally comprises an inner vessel 12, an outer casing 14, a particulate matrix 16, a cover 18 and impact limiters 20, 22. Inner vessel 12 forms a chamber 24 structured and configured to receive and contain radioactive material therein. Inner vessel 12 is preferably composed of a metallic material such as stainless steel or like material possessing structural rigidity, yield strength and the capability of effectively shielding photon radiation, such as gamma rays, that are emitted from radioactive material stored therein. An opening 26 on inner vessel 12 provides external access to chamber 24. Outer casing 14, which provides photon radiation shielding capability, is also preferably composed of a metallic material such as stainless steel or like material and surrounds inner vessel 12 such that a space 28 is defmed between the inner vessel 12 and the outer casing 14. Space 28, which is preferably annular, completely envelops chamber 24, with the distance between inner vessel 12 and outer casing 14 being generally uniform around chamber 24. Space 28 is filled with particulate matrix 16 which is a neutron attenuator and absorber. Outer casing 14 also serves as a protective covering for inner vessel 12.

Cover 18 is placed over opening 26 and completely seals chamber 24. Cover 18 includes an outer wall 30, an inner wall 32 and a cavity 34 disposed between outer wall 30 and inner wall 32. Outer wall 30 and inner wall 32 are preferably stainless steel. Cavity 34 is also filled with particulate matrix 16 to provide neutron attenuation and absorption.

Referring also to FIG. 2, particulate matrix 16 comprises a plurality of metallic particles 36 tightly packed together. Metallic particles 36 are typically composed of depleted uranium or lead and are preferably but not necessarily spherical as shown, however, the use of spherical particles assures a maximum packing density so that the thickness of space 28 can be minimized. The advantage gained by minimizing the thickness of space 28 is that heat generated by the radioactive contents stored within chamber 24 is more easily dissipated by thermal conduction. Depleted uranium and lead both have the capability of attenuating photon radiation from radioactive materials, but by themselves cannot absorb or attenuate neutrons. Therefore, the voids or interstices 38 present between metallic particles 36 is filled with a neutron absorbing material 40.

Neutron absorbing material 40 provides both moderation and absorption of neutrons emitted from radioactive materials stored therein. Conventionally known hydrogenous and neutron poison materials are used to formulate neutron absorbing material 40. Preferably, neutron absorbing material 40 is an aggregate mixture composed primarily of calcium sulfate, boric acid and water. Approximately, two parts calcium sulfate is mixed with one part boric acid and one part water to form a pourable aggregate mixture containing the neutron moderator and absorber. The mixture is poured or injected into annular space 28 formed between the inner vessel 12 and the outer casing 14. Metallic particles 36 are then added to the mixture which settle to the bottom 42 of space 28 and begin filling up to the top 44 of space 28. Vibrating the mixture during filling is helpful for settling metallic particles 36 properly within space 28. The mixture containing the metallic particles 36 generally harden within an hour, thus forming particulate matrix 16 which shields against both photon and neutron penetration.

The hydrogen present in the water is known to be a neutron moderator, which has the effect of slowing the neutrons as they pass through the water. Borated water, which contains boron, can also be used in the aggregate mixture. Since boron is a natural neutron absorber, borated water increases the ability of the aggregate mixture to absorb neutrons, in addition to its effectiveness as a gamma shield. The combination of hydrogen and boron within the mixture, therefore provides the neutron moderation and absorption. The use of particulate matrix 16 in space 28 eliminates the requirement for a separate neutron shield, and the thermal conductivity of apparatus 10 need not be degraded by the application of such a separate neutron shield. The packing efficiency of particulate matrix 16 is preferably approximately 62.5%. The density of neutron particulate matrix 16 using depleted uranium spheres is preferably approximately 60% of the weight of solid lead or approximately 7.09 $g/cm^3$, and its photon shielding capabilities would be equivalent to that of lead occupying the same volume, however, the use of depleted uranium in particulate matrix 16 provides the added advantage of incorporating hydrogen atoms for neutron moderation and boron atoms for neutron absorption.

The size of metallic particles 36 must be large enough to eliminate the possibility of pyrophoric ignition. The volume of metallic particles 36 is typically in a range between approximately 50% to 70% of the volume of particulate matrix 16. Preferably, the minimum diameter of the metallic particles 36 must be at least 0.5 mm, and the maximum diameter is selected so that the packing efficiency is maximized. Other factors determining maximum sphere diameter are the practically and availability of manufacturing methods and associated production costs.

Particulate matrix 16 adds strength and stiffness to apparatus 10 while also providing an effective impact limiter. Kinetic energy due to physical impact on apparatus 10, which may occur during transportation of apparatus 10, would be dissipated by the crushing of particulate matrix 16 at the point of impact. Therefore, outer casing 12 only requires sufficient ductility and tensile strength to deform without rupturing. The addition of impact limiters 20, 22, which are typically fabricated from wood, provide further impact or shock absorption to apparatus 10.

Retrieval and/or recycling of metallic particles 36 in particulate matrix 16 is possible using conventional techniques. For instance, particulate matrix 16 would be broken up into small pieces by mechanical agitation, such as vigorous shaking, air blasting or the like.

Accordingly, it will be seen that this invention provides for a vessel which allows for storing and/or transporting radioactive materials, which minimizes space requirements due to its "thin wall" design, and which has metallic components that can be recycled using conventional techniques. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for storing or transporting radioactive materials, comprising:

(a) an inner vessel structured and configured to receive radioactive material therein;

(b) an outer casing enclosing said inner vessel, wherein a space is defined between said inner vessel and said outer casing;

(c) a matrix comprising a plurality of high-density metal particles interspersed within said space, said metal particles closely packed together such that interstices are formed therebetween;

(d) a mixture of calcium sulfate, boric acid and water disposed throughout said interstices; and (e) means for sealing and opening said inner vessel.

2. An apparatus as recited in claim 1, wherein said metal particles are composed of depleted uranium.

3. An apparatus as recited in claim 1, wherein said metal particles are composed of lead.

4. An apparatus as recited in claim 1, wherein said metal particles are spherical.

5. An apparatus as recited in claim 1, wherein said space defined between said inner vessel and said outer casing is generally annular.

6. An apparatus as recited in claim 1, wherein said sealing and opening means comprises:

(a) a cover, said cover including an outer wall and an inner wall;

(b) a cavity defined between said outer wall and said inner wall;

(c) a matrix comprising a plurality of high-density metal particles disposed within said cavity, said metal particles forming interstices therebetween; and (c) neutron absorbing material, said material disposed throughout said interstices.

7. An apparatus for storing or transporting radioactive materials, comprising:

(a) an inner vessel structured and configured to receive radioactive material therein;

(b) an outer casing enclosing said inner vessel, wherein a generally annular space is defined between said inner vessel and said outer casing;

(c) a matrix comprising a plurality of high-density metal particles interspersed within said space, said metal particles closely packed such that interstices are formed therebetween;

(d) a mixture of calcium sulfate, boric acid and water disposed throughout said interstices; and (e) means for sealing and opening said inner vessel.

8. An apparatus as recited in claim 7, wherein said metal particles are composed of depleted uranium.

9. An apparatus as recited in claim 7, wherein said metal particles are composed of depleted uranium.

10. An apparatus as recited in claim 7, wherein said metal particles are spherical.

11. An apparatus as recited in claim 7, wherein said sealing and opening means comprises:

(a) a cover, said cover including an outer wall and an inner wall wherein a cavity is defined between said outer wall and said inner wall;

(b) a matrix comprising a plurality of high-density metal particles interspersed within said cavity, said metal particles forming interstices therebetween; and (c) neutron absorbing material, said material disposed throughout said interstices.

12. An apparatus for storing or transporting radioactive materials, comprising:

(a) an inner vessel structured and configured to receive radioactive material therein;

(b) an outer casing enclosing said inner vessel, wherein an annular space is formed between said inner vessel and said outer casing;

(c) a cover, said cover including an outer wall and an inner wall wherein a cavity is defined between said outer wall and said inner wall;

(d) a matrix comprising a plurality of high-density metal particles interspersed within said annular space and said cavity, said metal particles closely packed such that interstices are formed therebetween; and (e) a mixture of calcium sulfate, boric acid and water disposed throughout said interstices.

13. An apparatus as recited in claim 12, wherein said metal particles are composed of depleted uranium.

14. An apparatus as recited in claim 12, wherein said metal particles are composed of lead.

15. An apparatus as recited in claim 12, wherein said metal particles are spherical.

* * * * *